United States Patent [19]

Davis

[11] 4,224,916

[45] Sep. 30, 1980

[54] TIMING CONTROL FOR FUEL INJECTION PUMP

[75] Inventor: Charles W. Davis, Simsbury, Conn.

[73] Assignee: Stanadyne, Inc., Windsor, Conn.

[21] Appl. No.: 959,908

[22] Filed: Nov. 13, 1978

[51] Int. Cl.[3] ..... F02M 39/00

[52] U.S. Cl. ..... 123/502

[58] Field of Search ..... 123/139 AP, 139 AQ, 123/139 AL, 140 FG; 417/218

[56] References Cited

U.S. PATENT DOCUMENTS

| | | | |
|---|---|---|---|
| 3,101,078 | 8/1963 | Evans | 123/139 AQ |
| 3,433,159 | 3/1969 | Kemp | 123/139 AQ |
| 3,943,902 | 3/1976 | Skinner | 123/139 AQ |
| 3,951,117 | 4/1976 | Perr | 123/139 AP |
| 4,050,433 | 9/1977 | Tokashiki | 123/139 AQ |
| 4,074,667 | 2/1978 | Skinner | 123/139 AQ |
| 4,079,719 | 3/1978 | Varcoe et al. | 123/139 AQ |

*Primary Examiner*—Ira S. Lazarus

*Assistant Examiner*—Magdalen Moy

*Attorney, Agent, or Firm*—Prutzman, Kalb, Chilton & Alix

[57] ABSTRACT

A fuel injection pump having a mechanically adjustable servo valve for controlling the timing of the pumping event is disclosed. A pivoted lever has one end which engages the spring seat of a timing control plunger servo valve which is also subjected to a speed related hydraulic signal and another end which engages a cam clamped on the throttle shaft to pivot the lever according to the rotational position of the shaft. The profile of the cam is such as to retard the timing of the pumping stroke when the charge delivered by the pump is increased so that pressure built up in the pump is delayed and injection pressure is reached at a substantially constant crankshaft angle regardless of variations in speed and load on the engine. The mechanism is failsafe since it cannot interfere with the movement of the throttle shaft to reduce fuel delivery.

5 Claims, 4 Drawing Figures

TIMING CONTROL FOR FUEL INJECTION PUMP

This invention relates to an improved fuel injection pump of the type used for the sequential delivery of measured charges of fuel under high pressure to the cylinders of compression-ignition engines and more particularly to an improvement in such fuel pumps wherein the injection of fuel into the cylinders of the engine begins at a substantially constant crankshaft angle regardless of variations in load and speed of the engine throughout a prescribed speed range.

In the operation of internal combustion engines where fuel injection is employed, a metered charge of liquid fuel is delivered under high pressure to each engine cylinder in synchronism with the engine operating cycle. In injection pumps having inlet metering and wherein the contour of a cam is translated into pumping strokes of plungers actuated by the cam, there is a fixed termination of the pumping event for a fixed adjustment of the pumping cam. In order to obtain best performance and control exhaust emissions in such pumps, it is desirable to advance the timing of the pumping event relative to the engine operating cycle when engine speed is increased so that fuel injection begins at the same engine crank angle before top dead center at different speeds. In addition, it is desirable for fuel injection to begin at substantially the same engine crank angle during operation at different load levels.

Accordingly, it is a principal object of the invention to provide a new and improved fuel injection pump of the type described which includes a pump timing control which adjusts the timing of the pumping event as required for efficient operation and exhaust emissions control so that injection of fuel will begin at substantially the same engine crank angle under varying engine operating conditions. Included in this object is the provision of an injection pump timing control which provides more readily reproducible results from pump to pump.

It is another object of the invention to provide a fuel injection pump having a mechanically adjustable timing control for the pumping event which is simple in design, predictable in performance, and is readily adapted to provide any desired amount and schedule of timing change with changes in load and speed.

It is yet another object of the invention to provide a fuel injection pump having a mechanically adjustable servo valve for controlling the timing of the pumping event according to the amount of fuel being delivered to the engine. Included in this object is the provision of such a desigh wherein the mechanical control for the servo cannot interfere with the movement of the throttle to reduce the amount of fuel delivered to the engine.

Another object of the invention is the provision of an improved scheduled load related advance signal to provide reproducible timing advance throughout a prescribed load range regardless of variations in fuel viscosity and manufacturing variations in the pump and engine.

Other objects will be in part obvious and in part pointed out in more detail hereinafter.

A better understanding of the invention will be obtained from the following description and the accompanying drawings of an illustrative application of the invention.

Figure 1:
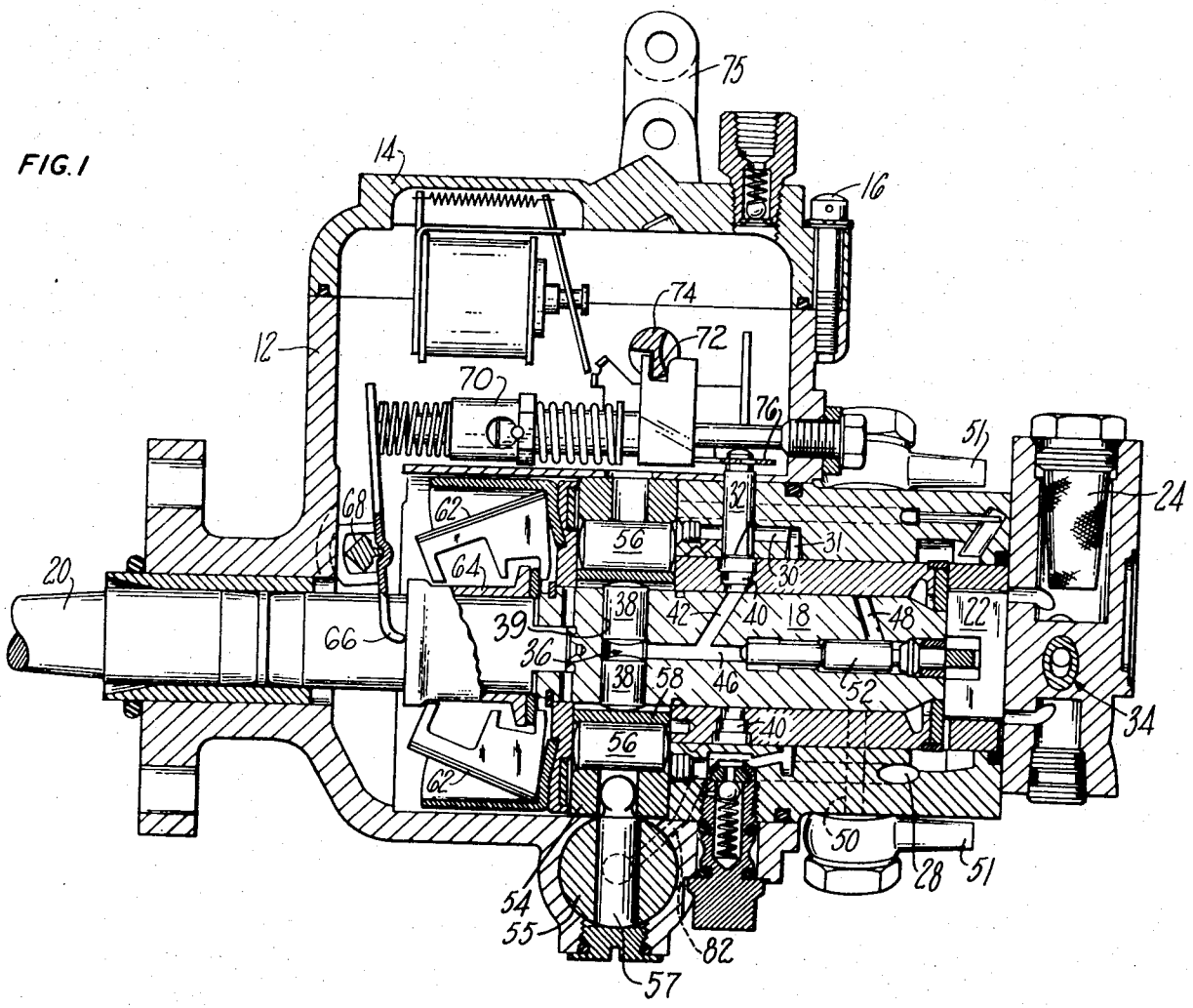
FIG. 1 is a longitudinal side elevational view, partly in section and partly broken away, of a fuel injection pump illustrating a preferred embodiment of the present invention.

Referring now to the drawings in detail, the fuel pump exemplifying the present invention is shown to be of the type adapted to supply sequential measured pulses or charges of fuel under high pressure to the several fuel injection nozzles of an internal combustion engine. The pump has a housing 12 provided with a cover 14 secured thereto by fasteners 16. A fuel distributing rotor 18 having a drive shaft 20 driven by the engine is journaled in the housing.

A vane-type transfer or the low pressure supply pump 22 is driven by the rotor 18 and receives fuel from a supply tank (not shown) through pump inlet 24. The output of the pump 22 is delivered under pressure via axial passage 28, annulus 31 and passage 30 to a metering valve 32. A transfer pump pressure regulating valve, generally denoted by the numeral 34, regulates the output pressure of the transfer pump and returns excess fuel to the pump inlet 24. The regulator 34 is designed to provide transfer pump output pressure which increases with engine speed in order to meet the increased fuel requirements of the engine at higher speeds and to provide a fuel pressure suitable for operating auxiliary mechanisms of the fuel pump.

A high pressure charge pump 36 comprising a pair of opposed plungers 38, mounted for reciprocation in a diametral bore 39 of the rotor, receives metered inlet fuel from the metering valve 32 through a plurality of angularly spaced radial ports 40 (only two of which are shown) adapted for sequential registration with a diagonal inlet passage 42 of rotor 18 as it is rotated.

A charge of fuel is pressurized to high pressure by the charge pump 36 and is delivered through an axial bore 46 of the rotor to a delivery passage 48 which registers sequentially with a plurality of angularly spaced outlet passages 50 (only one of which is shown) which communicate respectively with the individual fuel injection nozzles of the engine through discharge fittings 51 spaced around the periphery of the housing 12. A delivery valve 52 in the axial bore 46 operates to achieve sharp cut-off of fuel to the nozzles at the end of the pumping stroke of charge pump 36 to eliminate fuel dribble into the engine combustion chambers.

The angularly spaced passages 40 to the charge pump 36 are located around the periphery of the rotor bore to provide sequential registration with the diagonal inlet passage 42 of the rotor 18 during the intake stroke of the plungers 38, and the angularly spaced outlet passages 50 are similarly located to provide sequential registration with the distributor passage 48 during the compression stroke of the plungers.

An annular cam 54 having a plurality of pairs of diametrically opposed camming lobes is provided for simultaneously actuating the charge pump plungers 38 inwardly for periodically pressurizing the charge of fuel therebetween to thereby periodically deliver sequential charges of pressurized fuel to the engine. A pair of rollers 56 carried by roller shoes 58 are mounted by the rotor in radial alignment with the plungers 38 for camming the plungers inwardly.

For timing the distribution of the pressurized fuel to the fuel nozzles in proper synchronism with the engine operation, the annular cam 54 is adapted to be angularly adjusted by a suitable timing control piston 55 which is connected to cam 54 by connector pin 57.

A plurality of governor weights 62, mounted around pump shaft 20 for rotation therewith, provide a variable axial force on a sleeve 64 which is slidably mounted on shaft 20. The sleeve engages pivoted governor arm 66 to urge it clockwise, as viewed in FIG. 1, about a supporting pivot 68.

The governor arm 66 is urged in the opposite pivotal direction by a governor spring assembly 70, the axial position of which is adjustable by a cam 72 operated by throttle shaft 74 which is connected to the throttle arm 75. The throttle arm in turn is connected to the controlling foot pedal in the driver's compartment of the automobile.

The governor arm 66 is connected to control the angular position of the metering valve 32 through control arm 76 which is fixed to the metering valve in a manner fully described in copending application Ser. No. 838,314, filed Sept. 30, 1977 and now U.S. Pat. No. 4,142,499, in the name of Daniel E. Salzgeber and entitled Temperature Compensated Fuel Injection Pump.

As well known, the quantity or measure of the charge of fuel delivered by the charge pump in a single pumping stroke is readily controlled by varying the restriction offered by the metering valve 32 to the passage of fuel therethrough.

As described in the aforesaid copending application, the governor automatically regulates the engine speed in the idle speed range and at maximum speed with the metering of fuel at intermediate speeds being controlled solely by the mechanical actuation of the throttle foot pedal.

Figure 2:
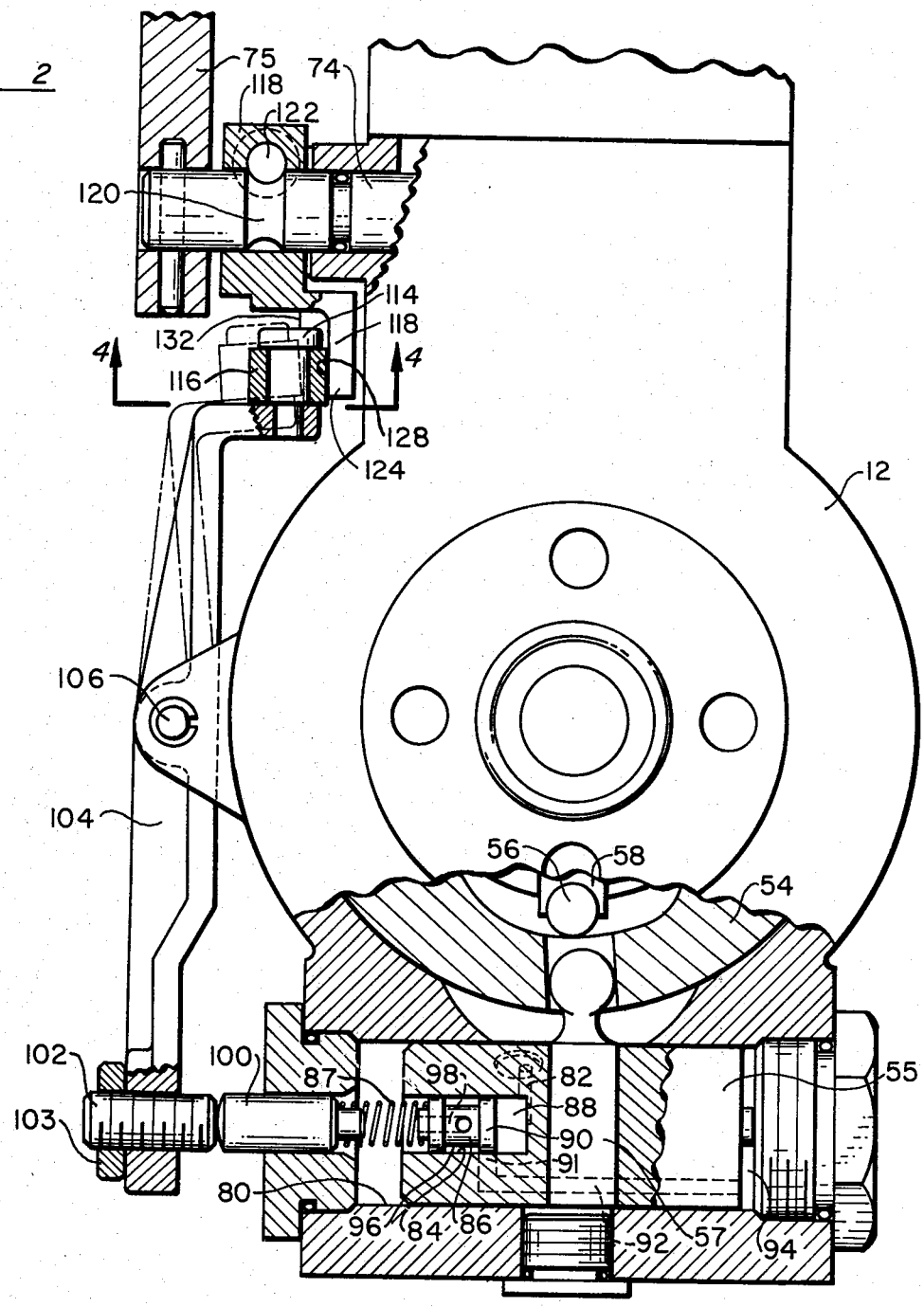
FIG. 2 is an enlarged end view, partly in section and partly broken away, of the fuel injection pump of FIG. 1.

Referring now specifically to FIG. 2, timing control piston 55 is slidably mounted in a transverse bore 80 which is parallel to throttle shaft 74. A passage 82 provides communication with the bore 80 and with axial output passage 28 from the transfer pump 22 to deliver regulated transfer pump output pressure thereto.

Piston 55 provides an axial bore 84 in which a servo valve 86 is slidably mounted. A servo biasing spring 87 engages one end of servo valve 86 to bias the servo valve to the right as shown in FIG. 2. In operation, regulated transfer pump output pressure is continuously present in valve chamber 88 at one end of the servo valve 86 to exert a force on the servo valve in opposition to the biasing force of spring 87. Inasmuch as the output pressure of the transfer pump is a function of engine speed, the position of servo valve 86 is dependent on engine speed.

As the pressure in valve chamber 88 increases with increased engine speed, it compresses the spring so that the land 90 of the servo valve uncovers the port 91 of passage 92 so that fuel may pass from chamber 88 into piston chamber 94 at the end of timing control piston 55. As the quantity of fuel in chamber 94 increases, it moves timing control piston 55 to the left until the land 90 covers the port 91 of passage 92 to terminate fuel flow between valve chamber 88 and piston chamber 94 at the equilibrium position of timing control piston 55 which fixes the angular position of cam 54 and the timing of injection.

If engine speed decreases, the pressure in valve chamber 88 decreases and the biasing force of servo spring 87 moves the servo piston to the right to provide communication between passage 92 and annulus 96 to dump fuel from the piston chamber 94 through bore 98 which communicates with the interior of the pump housing 12 until the equilibrium position of timing control piston 55 is again reached.

As shown in FIG. 2, one end of the servo spring 87 engages axially slidable spring seat 100, the axial position of which is determined by adjustable stop screw 102 of lever 104 which is pivoted by a pivot 106. Pivot 106 is mounted by a pair of ears projecting from the side of pump housing 12.

The opposite end of the lever 104 is provided with an axially extending cylindrical boss 114 on which a roller 116 is journaled.

As best shown in FIG. 2, a face cam 118 is adjustably clamped to throttle shaft 74 which is provided with an annular groove 120 to receive a portion of the clamping screw 122 to fix the axial position of the face cam 118 with respect to the throttle shaft 74.

The face cam 118 is provided with a radially projecting flange 124 providing a cam surface having a flat portion 128 at one end thereof, an intermediate sloping portion 130, and a flat portion 132 at the other end.

Figure 4:
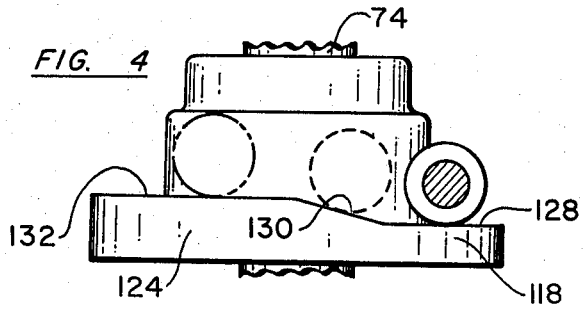
FIG. 4 is a fragmentary view taken along the lines 4—4 of FIG. 2.
Figure 3:
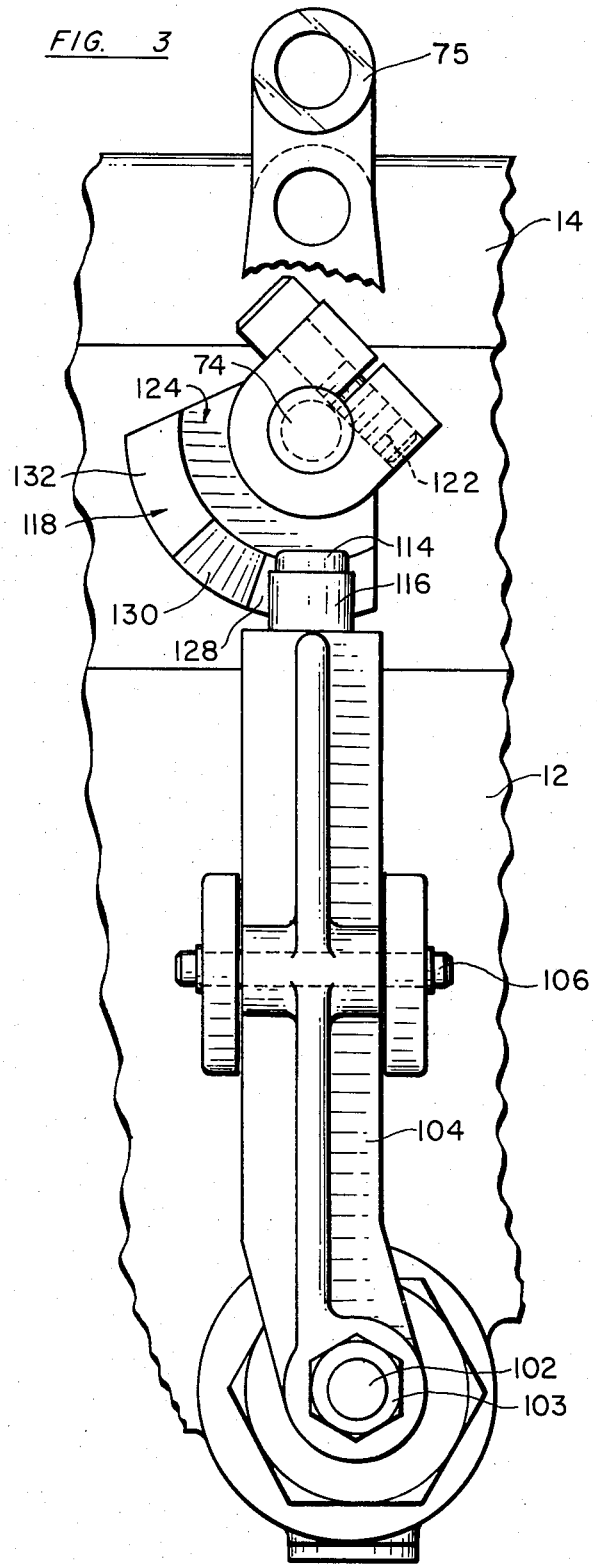
FIG. 3 is a fragmentary side elevational view thereof.

Roller 116 of lever 104 is engageable with the cam surfaces of face cam 118 to pivot the lever 104 thereby to shift servo spring seat 100 mechanically in accordance with the rotational position of throttle shaft 74. When the throttle arm 74 is rotated to a low load position, the roller 116 engages the flat cam surface 128 as shown in solid lines to shift the stop 100 the fullest distance to the left as viewed in FIG. 2 thereby to cause the timing control piston 55 to move to a position providing the maximum advance in injection timing for a given engine speed. As the throttle arm 75 is rotated from the position illustrated in FIG. 3, toward its full load position, the roller 116 engages the upwardly inclined ramp portion 130 of the face cam 118 as shown by the dashed lines of FIG. 4 to pivot the lever arm 104 in a direction to move the servo spring seat 100 to the right to dump some fuel from chamber 94 to retard the timing of injection.

As the throttle arm 75 is moved further toward its full load position, the cam member 118 is rotated so that the roller 116 engages the highest flat surface 132 of the cam to depress the servo spring seat 100 the maximum amount and thereby cause the timing control piston 55 to move to retard the timing the maximum amount for a given engine operating speed.

Since the metering valve 32 is controlled directly by the position of throttle arm 75 above the idle speed range, the shift in the angular position of the throttle shaft 74 is essentially proportional to the load on the engine. Moreover, the profile and the length of the sloping cam portion 130 may be varied to change the portion of the load range and the amount of change in injection timing which will result from a given change in load level. Further, by controlling the axial distance between cam portions 128 and 132, the maximum amount of change in injection timing which may be obtained by changes in the load level on the engine may be easily varied.

In order to adjust the injection timing, the output pressure of the transfer pump is first adjusted. The throttle arm 75 is then moved to open the metering valve to its full open position at a prescribed pump speed and the adjusting screw 100 is adjusted to provide the desired amount of injection timing advance with the face cam 118 angularly adjusted so that the roller 116 engages the full load flat portion 132 of the face cam 118. After this adjustment is made and lock nut 103 is tightened, the metering valve is positioned for a part-load condition where the roller engages on the sloping portion 130 of the face cam 118 and the face cam is angularly adjusted with respect to the throttle shaft until the desired injection timing is obtained. The adjusting screw 122 is tightened to clamp the face cam 118 to the throttle shaft 74.

Thus the timing of the pumping event is tied directly to the throttle shaft position and engine speed and, since the face cam is easily adjustable with respect to the throttle shaft position, the timing of the injection under given speed and load conditions is easily reproducible from pump to pump and is predictable despite manufacturing variations from pump to pump. Moreover, since the roller 116 engages the flat surface 132 of the face cam 118 at full throttle position, the design is failsafe since the throttle shaft 74 may be rotated to close the metering valve even if the lever 104 binds or cannot be rotated for any reason.

As will be apparent to persons skilled in the art, various modifications, adaptations and variations of the foregoing specific disclosure can be made without departing from the teachings of the present invention.

I claim:

1. A fuel injection pump having pumping plungers and timing means to vary the timing of the pumping strokes, a timing control piston in a closed cylinder connected with the timing means to actuate the same, a passageway communicating with the closed cylinder, a servo valve intersecting the passageway, a servo valve biasing spring, and a source of fluid under a pressure correlated with engine speed acting on the servo valve against the bias of the servo valve biasing spring, characterized by a movable spring seat for the servo valve biasing spring, a movable throttle for mechanically controlling the quantity of fuel delivered by a single pumping stroke, and a pivoted lever having one end engaging said spring seat and its other end engaaging a cam fixed to the throttle to change the biasing force of the servo valve biasing spring with movement of the throttle.

2. A fuel injection pump according to claim 1 further characterized in that the throttle cam is a face cam which is axially fixed and angularly adjustable on the throttle shaft.

3. A fuel injection pump according to claim 2 further characterized in that the one end of the lever is adjustable relative to the spring seat.

4. A fuel injection pump according to claim 2 further characterized in that the face cam having axially flat end portions joined by an intermediate axially inclined portion.

5. A fuel injection pump according to claim 4 further characterized in that the throttle and the timing control piston are mounted in parallel bores in the pump housing.

* * * * *